US010674807B2

(12) United States Patent
Aso et al.

(10) Patent No.: US 10,674,807 B2
(45) Date of Patent: Jun. 9, 2020

(54) COSMETIC BRUSH

(71) Applicant: SINWA CORPORATION, Kanagawa (JP)

(72) Inventors: Hironori Aso, Kanagawa (JP); Akihiro Tanaka, Kanagawa (JP)

(73) Assignee: SINWA CORPORATION, Kanagawa (JP)

( * ) Notice: Subject to any disclaimer, the term of this patent is extended or adjusted under 35 U.S.C. 154(b) by 458 days.

(21) Appl. No.: 15/501,136

(22) PCT Filed: Aug. 8, 2014

(86) PCT No.: PCT/JP2014/071091
§ 371 (c)(1),
(2) Date: Feb. 1, 2017

(87) PCT Pub. No.: WO2016/021069
PCT Pub. Date: Feb. 11, 2016

(65) Prior Publication Data

US 2017/0215566 A1 Aug. 3, 2017

(51) Int. Cl.
*A46B 3/16* (2006.01)
*A46B 9/02* (2006.01)
(Continued)

(52) U.S. Cl.
CPC ..... *A46B 9/021* (2013.01); *A45D 34/04* (2013.01); *A46B 3/16* (2013.01); *A46B 9/026* (2013.01);
(Continued)

(58) Field of Classification Search
CPC .. A46D 1/02; A46D 1/023; A46B 3/18; A46B 9/021; A46B 2200/1053
(Continued)

(56) References Cited

U.S. PATENT DOCUMENTS 2,278,928 A * 4/1942 Herold ..... A46B 13/003 15/198
5,604,952 A * 2/1997 Zeleznick ..... A46B 3/18 15/167.1
(Continued)

FOREIGN PATENT DOCUMENTS

JP 2003-299522 A 10/2003
JP 3482383 B 12/2003
(Continued)

OTHER PUBLICATIONS

International Search Report issued in a corresponding application PCT/JP2014/071091 dated Nov. 11, 2014.

*Primary Examiner* — Tatiana L Nobrega
(74) *Attorney, Agent, or Firm* — Roberts Calderon Safran & Cole P.C.

(57) ABSTRACT

A cosmetic brush is provided that is capable of enhancing an ability to retain a liquid cosmetic material and making fine adjustment to the eyelashes easier. The cosmetic brush comprises a core wire part and a bristle group radially attached to the core wire part around an axis of the core wire part continuously in a helical state in an axial direction of the core wire part. The bristle group has bristles each constituted by integrating a basic fiber made up of a plurality of bundled constituent fibers and a wound fiber helically wound around an outer circumferential surface of the basic fiber.

10 Claims, 5 Drawing Sheets

(51) Int. Cl.
*A45D 34/04* (2006.01)
*A46B 9/06* (2006.01)
*A45D 40/26* (2006.01)

(52) U.S. Cl.
CPC ..... *A46B 9/028* (2013.01); *A46B 9/06* (2013.01); *A45D 34/042* (2013.01); *A45D 40/262* (2013.01); *A46B 2200/1053* (2013.01)

(58) Field of Classification Search
USPC ..... 15/206, 207.2
See application file for complete search history.

(56) References Cited

U.S. PATENT DOCUMENTS

| | | | | | |
|---|---|---|---|---|---|
| 5,987,691 | A * | 11/1999 | Jurt | A46D 1/023 | 15/167.1 |
| 6,161,243 | A * | 12/2000 | Weihrauch | A46D 1/00 | 15/167.1 |
| 6,280,113 | B1 * | 8/2001 | Gueret | A45D 34/045 | 132/218 |
| 9,681,743 | B2 * | 6/2017 | Xi | A46B 11/0068 | |
| 2008/0005859 | A1 * | 1/2008 | Niizaki | A46D 1/00 | 15/207.2 |
| 2017/0020275 | A1 * | 1/2017 | Xi | A46B 11/0068 | |

FOREIGN PATENT DOCUMENTS

| | | | | |
|---|---|---|---|---|
| JP | 2005-130963 | A | 5/2005 | |
| JP | 2005130963 | * | 5/2005 | A45D 34/04 |
| JP | 2012-147986 | A | 8/2012 | |
| JP | 5507676 | B | 5/2014 | |

* cited by examiner

COSMETIC BRUSH

CROSS-REFERENCE TO RELATED APPLICATIONS

The present application is a U.S. National Phase of PCT/JP2014/071091 filed on Aug. 8, 2014. The disclosure of the PCT Application is hereby incorporated by reference into the present Application.

TECHNICAL FIELD

The present invention relates to a cosmetic brush used for applying a liquid cosmetic material such as mascara.

BACKGROUND ART

A cosmetic brush used for applying a liquid cosmetic material such as mascara generally includes, as described in Patent Document 1, a core wire part and a bristle group (a brush bristle group, a needle bristle group) radially attached to the core wire part around an axis of the core wire part continuously in a helical state in the axial direction of the core wire part.

In this brush, the bristle group constitutes a substantially columnar brush part, and the bristle group can be immersed in a liquid cosmetic material to cause the liquid cosmetic material to adhere to bristles in the bristle group such that the liquid cosmetic material is retained between the adjacent bristles. Therefore, by putting a side surface of the bristle group to an object of application such as the eyelashes, the liquid cosmetic material retained in the bristle group can be applied to the object of application.

PRIOR ART DOCUMENT

Patent Document

Patent Document 1: Japanese Patent No. 5507676

SUMMARY OF THE INVENTION

Problem to be Solved by the Invention

However, in the cosmetic brush described above, outer circumferential surfaces of the bristles of the bristle group is each formed as a smooth continuous surface, so that an ability of each bristle itself or in a space between the adjacent bristles to retain a liquid cosmetic material is not considered sufficiently high, and it is desirable to enhance the ability to retain a liquid cosmetic material from the viewpoint of increasing the volume of the eyelashes, etc.

Additionally, in the cosmetic brush described above, forming the outer circumferential surface of each bristle as a smooth continuous surface does not sufficiently enhance a trapping performance and a trapping retaining performance (a catching performance) with respect to the eyelashes, resulting in limitations on easily performing fine adjustments such as curling of the eyelashes and increasing the volume of the eyelashes.

The present invention was conceived in view of the situations and it is therefore an object of the present invention to provide a cosmetic brush capable of enhancing the ability to retain a liquid cosmetic material and making fine adjustments to the eyelashes easier.

Means for Solving Problem

To achieved the object, the present invention provides a cosmetic brush comprising a core wire part; and a bristle group radially attached to the core wire part around an axis of the core wire part continuously in a helical state in an axial direction of the core wire part, the bristle group having bristles each made up of a basic fiber and a wound fiber helically wound around an outer circumferential surface of the basic fiber in an integrated state, wherein the basic fiber is constituted by bundling a plurality of constituent fibers, wherein the outer circumferential surface of the basic fiber has groove-like recesses each formed between the constituent fibers adjacent to each other, and wherein the wound fiber is helically wound around the plurality of bundled constituent fibers.

Effect of the Invention

According to the present invention, since the bristles are each made up of a basic fiber and a wound fiber helically wound around an outer circumferential surface of the basic fiber in an integrated state, a helical protrusion is formed by the wound fiber on the outer circumferential surface of the basic fiber so that a specific surface area (an adhesion area of a liquid cosmetic material (a surface area per unit volume or unit weight)) can be increased on each of the bristles as compared to the case without the protrusion formed on the outer circumferential surface of each of the bristles, and a multiplicity of fine retaining spaces can be formed between the adjacent bristles by the helical protrusion on each of the bristles. Therefore, the cosmetic brush can enhance the ability to retain the liquid cosmetic material.

Additionally, under the bristle group radially attached to the core wire part around the axis of the core wire part continuously in a helical state in the axial direction of the core wire part, each of the bristles has the helical protrusion formed by the wound fiber on the outer circumferential surface of the basic fiber and, therefore, the helical state of the bristle group and the helical state of the protrusion (wound fiber) on each of the bristles are both effectively used, and the protrusion on each of the bristles protrudes in various directions, so that the trapping performance and the trapping retaining performance (the catching performance) of the bristles can be enhanced with respect to the eyelashes in the use of the cosmetic brush. Thus, by using the cosmetic brush, a contact time (an involvement time) of the bristles can be increased with respect to the eyelashes so as to increase a treatment time by the bristles as well as an application time and an application amount of the liquid cosmetic material to the eyelashes. As a result, fine adjustments such as curling of the eyelashes and increasing the volume of the eyelashes can more easily be performed.

Furthermore, since each of the bristles has the wound fiber helically wound around the outer circumferential surface of the basic fiber to form the helical protrusion, if the liquid cosmetic material used contains fibers, the fibers contained in the liquid cosmetic material can more easily be entangled with the helical protrusion (wound fiber) on each of the bristles when the bristle group is immersed in the liquid cosmetic material. Therefore, by using the cosmetic brush, the liquid cosmetic material containing fibers can adequately be retained in the bristle group.

Moreover, since each of the bristles has the wound fiber helically wound around the outer circumferential surface of the basic fiber to employ a reinforcing structure, the bristles can be enhanced in strength and rigidity.

Besides, since the basic fiber is constituted by bundling a plurality of constituent fibers so that the outer circumferential surface of the basic fiber has groove-like recesses each formed between the constituent fibers adjacent to each other and the wound fiber is helically wound around the plurality of bundled constituent fibers, not only the same aforementioned advantageous effects can be produced, but also the basic fiber in each of the bristles can be increased in the specific surface area of the outer circumferential surface thereof (the adhesion area of the liquid cosmetic) because of the groove-like recesses between the adjacent constituent fibers on the outer circumferential surface of the basic fiber. Therefore, the cosmetic brush can further enhance the ability to retain the liquid cosmetic material.

Since the liquid cosmetic material is easily retained in the groove-like recesses in this case and the groove-like recesses are extended in the axial direction of the basic fiber and sequentially arranged on the outer circumferential surface of the basic fiber in the circumferential direction thereof, the liquid cosmetic material is retained in each of the recesses so that a large amount of the liquid cosmetic material can be retained on the entire outer circumferential surface of the basic fiber without unevenness.

Moreover, since each of the bristles has the wound fiber helically wound around the outer circumferential surface of the basic fiber to strongly bundle a plurality of the constituent fibers with the wound fiber, a large frictional force etc. can be generated between the constituent fibers, and the strength and rigidity of the bristles can be increased from this viewpoint. Therefore, even though the bristle group is improved in the ability to retain the liquid cosmetic material as described above (even though a large amount of the cosmetic liquid material can be retained), the strength and rigidity capable of adequately corresponding to the improvement can be ensured in each of the bristles and the function of the bristles as comb teeth can be improved.

According to a preferable aspect of the invention, since a plurality of constituent fibers serving as the basic fiber is twisted around the axis of the basic fiber, the groove-like recesses formed between the adjacent constituent fibers are accordingly twisted on the outer circumferential surface of the basic fiber (the plurality of the constituent fibers), and an amount of elongation of each of the recesses can be increased as compared to that of a groove-like recess extending straight in the axial direction of the basic fiber under the equal condition of the entire length of the basic fiber. Therefore, the basic fiber having such groove-like recesses can further be increased in the adhesion area of the liquid cosmetic material so that each of the bristles can further be improved in the ability to retain the liquid cosmetic material.

Additionally, since a plurality of the bundled constituent fibers serving as the basic fiber is twisted, the constituent fibers on the outer circumferential side tighten a bundle of the constituent fibers on the inner circumferential side so that the constituent fibers on the inner circumferential side can strongly be bundled also by the constituent fibers on the outer circumferential side. Therefore, a large frictional force etc. can be generated by twisting the plurality of the constituent fibers between the constituent fibers so as to further increase the rigidity and strength of each of the bristles and, even though the ability to retain the liquid cosmetic material is improved, the strength etc. corresponding to the improvement can accordingly more reliably be achieved in each of the bristles.

According to another preferable aspect of the invention, since the wound fiber and each of the constituent fibers are arranged to intersect with each other based on the helical direction of the wound fiber and the twist direction of the constituent fibers and the wound fiber and each of the constituent fibers are extended away from each other in the axial direction of the basic fiber as these fibers go further in the circumferential direction of the basic fiber from each of intersections therebetween, the whole of the plurality of the constituent fibers can be tightened through the effective tightening of the constituent fibers on the outer circumference side by the wound fiber, so that the whole of the plurality of the constituent fibers making up the basic fiber can strongly be bundled. Therefore, the bristles can further be enhanced in the strength and rigidity and, even though the ability to retain the liquid cosmetic material is improved, the cosmetic brush preferably corresponding to the improvement can accordingly be provided in terms of strength etc.

MODES FOR CARRYING OUT THE INVENTION

An embodiment of the present invention will now be described.

Figure 1:
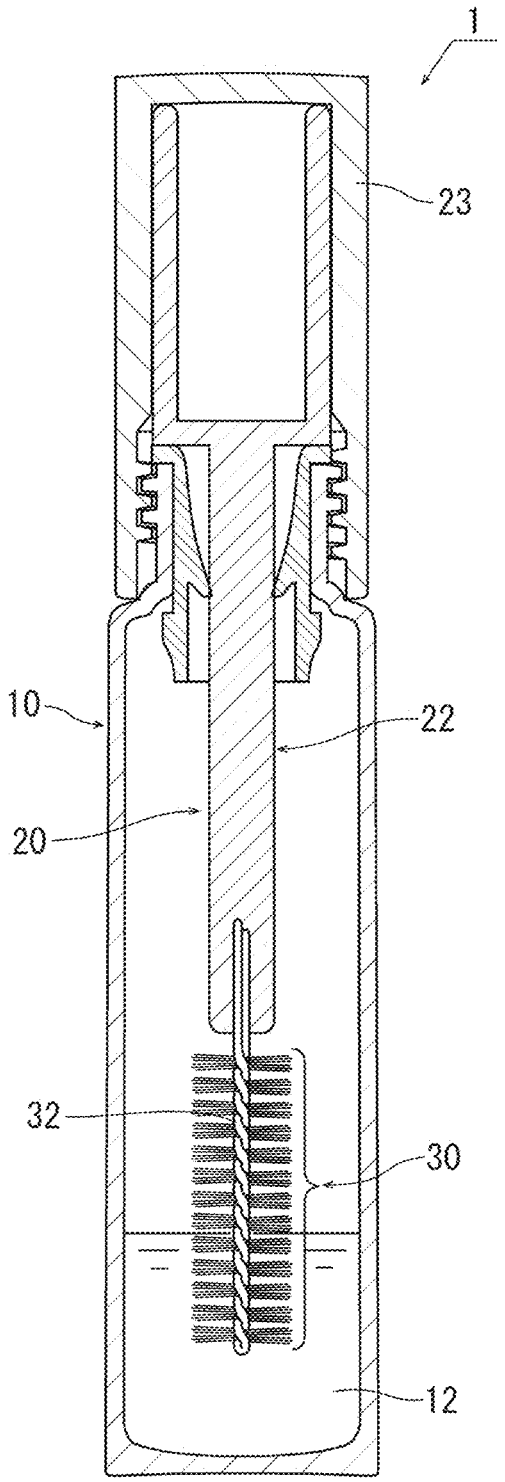
FIG. 1 is a longitudinal sectional view of a mascara applicator using a mascara brush according to an embodiment.

In FIG. 1, reference numeral 1 denotes a mascara applicator. The mascara applicator 1 includes a cosmetic material container 10 and a mascara brush 20 serving as a cosmetic brush inserted in the cosmetic material container 10.

As shown in FIG. 1, the cosmetic material container 10 is formed into a generally elongated bottomed cylindrical shape and has a mascara liquid 12 contained therein as a liquid cosmetic material.

Figure 2:
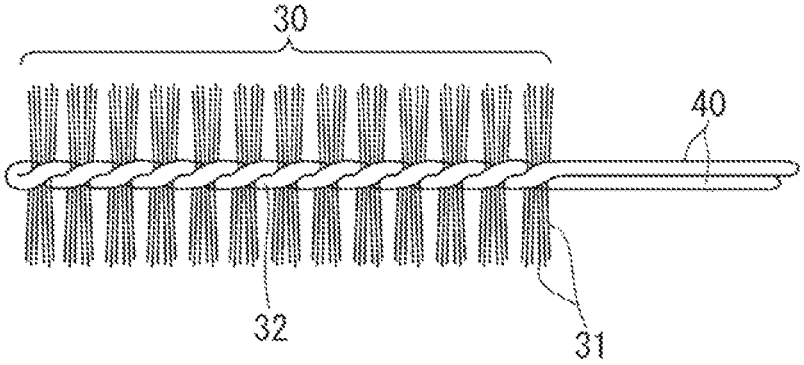
FIG. 2 is an enlarged front view of a main portion of the mascara brush according to the embodiment.
Figure 3:
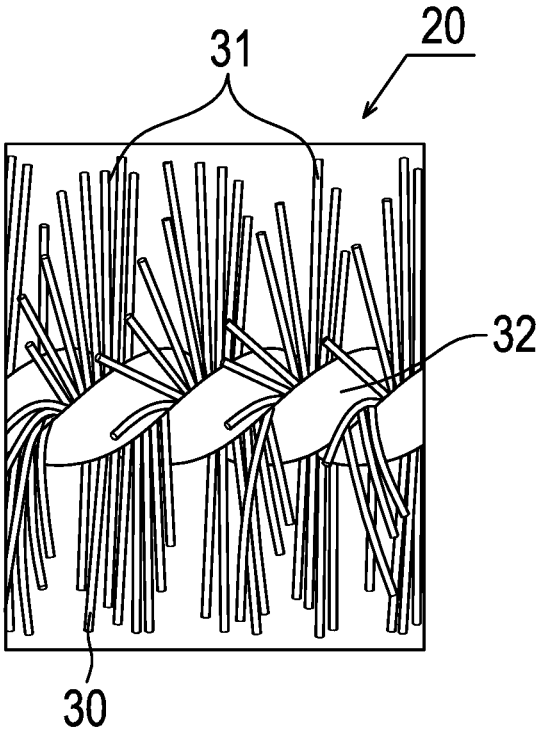
FIG. 3 is an enlarged photographic view of a brush part of the mascara brush according to the embodiment.

As show in FIGS. 1 to 3, in this embodiment, the mascara brush 20 includes a core wire part 32, a brush shaft part 22 having one end portion attached to a base end portion of the core wire part 32, and a bristle group 30 formed on the core wire part 32 from an inner side in an extending direction than the base end portion to a tip portion of the core wire part 32.

In this embodiment, as shown in FIGS. 1 to 3, the core wire part 32 is formed by twisting a pair of metal wires 40 together, and the twisted pair of the metal wires 40 is extended straight over a certain length.

As shown in FIG. 1, the brush shaft part 22 is a part grasped by a user and includes on the other end portion of the brush shaft part 22 a cap 23 that can be attached by insertion to an opening portion of the cosmetic material container 10 when the core wire part 32 and one end portion side of the brush shaft part 22 are inserted into the cosmetic material container 10.

As shown in FIGS. 1 to 3, the bristle group 30 is made up of a multiplicity (plurality) of bristles (brush bristles, needle bristles) 31 so as to form a brush part having a substantially columnar shape as a whole. The multiplicity of the bristles 31 is radially attached to the core wire part 32 around the axis of the core wire part 32 in an existing region thereof (a region from the inner side in the extending direction than the base end portion to the tip portion of the core wire part 32) and the radial state of the bristles 31 is continuous in a helical state in the axial direction of the core wire part 32. Moreover, the helical state of the continuous bristles 31 is loosened in the axial direction of the core wires 32 and, in a region without a bristle in the original helical state, the bristles 31 are disposed in a state of spreading in the axial direction of the core wires 32 (see FIG. 2).

Figure 7:
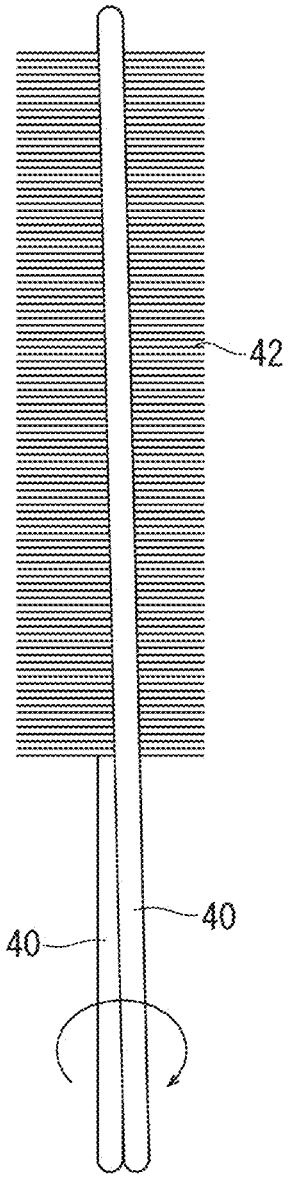
FIG. 7 is an explanatory diagram for explaining a manufacturing method of the mascara brush (the brush part) according to the embodiment.

Therefore, when the bristle group 30 as described above is formed into the core wire part 32, as shown in FIG. 7, a multiplicity of manufacturing bristles 42 having a sufficiently long length is prepared and, after the multiplicity of the manufacturing bristles 42 is held at central portions in the extending direction between a pair of metal wires 40, 40 constituting the core wire part 32, the pair of the metal wires 40 is twisted in a direction of an arrow of FIG. 7. In this case, the structure of the bristles 31 disposed in a state of spreading in the axial direction of the core wires 32 in a region without a bristle in the original helical state is related to the manufacturing bristles 42 having the same modified cross-section as the modified cross-section of the bristles 31 described later and the twisting of the bristles 42 with the pair of the metal wires 40, 40.

Figure 4:
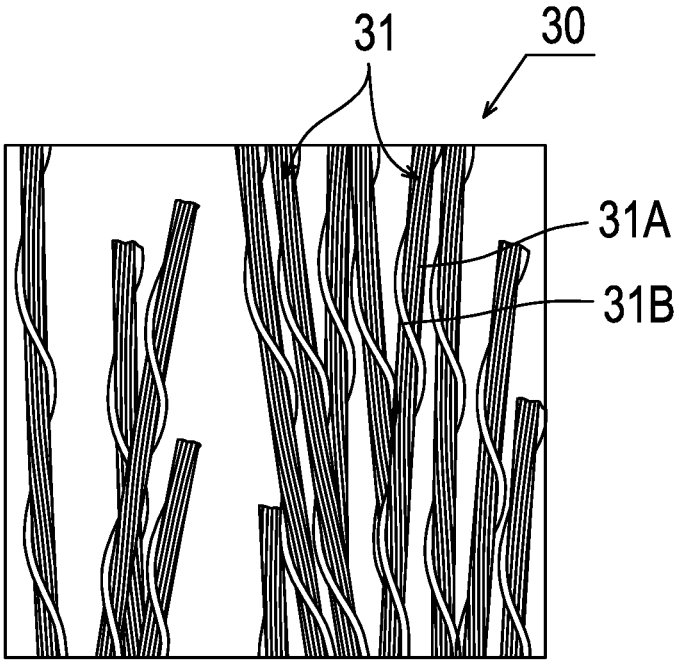
FIG. 4 is an enlarged photographic view of a bristle group of the brush part of the mascara brush according to the embodiment.
Figure 5:
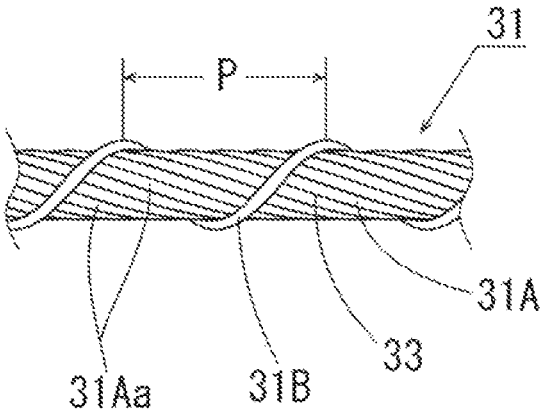
FIG. 5 is an enlarged view of a portion of a bristle of the brush part according to the embodiment.

As shown in FIGS. 4 and 5, the bristles 31 are each made up of a basic fiber 31A and a wound fiber 31B wound around an outer circumferential surface of the basic fiber 31A in an integrated state.

Figure 6:
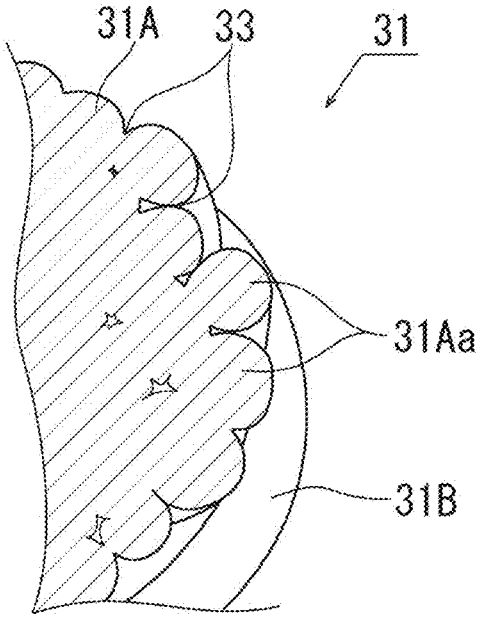
FIG. 6 is an enlarged cross-sectional view of a portion of the bristle according to the embodiment.

The basic fiber 31A has the entire length (the length from the core wire part 32 to the tip of the basic fiber 31A) set to about 3 mm and the diameter of the basic fiber 31A is set to about 0.07 to 0.13 mm. In this embodiment, the basic fiber 31A is formed by bundling a plurality of constituent fibers 31Aa, and the constituent fibers 31Aa are integrated by welding as shown in FIG. 6. As a result, on the outer circumferential surface of the basic fiber 31A, fine groove-like recesses 33 are formed between the adjacent constituent fibers 31Aa, and the fine groove-like recesses 33 are sequentially arranged in the circumferential direction of the basic fiber 31A and each extended over the entire axial length of the basic fiber 31A.

Moreover, in this case, the plurality of the constituent fibers 31Aa is twisted around the axis of the basic fiber 31A. Therefore, the fine groove-like recesses 33 are extended in the axial direction of the basic fiber 31A while forming a helical state on the outer circumferential surface of the basic fiber 31A, so that an amount of elongation of the fine groove-like recesses 33 is made longer than that in the case of extending straight in the axial direction of the basic fiber 31A under the equal condition of the entire length of the basic fiber 31A, and the specific surface area of the outer circumferential surface of the basic fiber 31A in each of the bristles 31 is made considerably larger because of the presence of the plurality of the fine recesses 33 as compared to the case of forming the basic fiber 31A from one constituent fiber (having a smooth outer circumferential surface).

Additionally, since the plurality of the constituent fibers 31Aa is twisted around the axis of the basic fiber 31A, the constituent fibers 31Aa on the outer circumferential side out of the plurality of the constituent fibers 31Aa tighten a bundle of the constituent fibers 31Aa on the inner circumferential side. Therefore, the constituent fibers 31Aa on the outer circumferential side strongly bundle the constituent fibers 31Aa on the inner circumferential side and a large frictional force etc. are generated between the constituent fibers 31Aa, so that the rigidity and strength of the bristles 31 are further increased. For the constituent fibers 31Aa as described above, a known material such as a PET resin (polyethylene terephthalate) is used.

As shown in FIGS. 4 and 5, the wound fiber 31B is helically wound around the basic fiber 31A (the plurality of the constituent fibers 31Aa).

The wound fiber 31B and the basic fiber 31A are integrated by welding, and a helical protrusion (hereinafter denoted by same reference numeral as the wound fiber 31B) is formed by the wound fiber 31B on the outer circumferential surface of the basic fiber 31A. As a result, the specific surface area (the adhesion area of the mascara liquid 12) of each of the bristles 31 is increased not only because of an increase in the specific surface area due to the outer circumferential surface of the basic fiber 31A itself described above (based on the plurality of the fine groove-like recesses 33) but also by the helical protrusion 31B on the outer circumferential surface of the basic fiber 31A, so that the specific surface area of each of the bristles 31 is made larger as compared to the case without the helical protrusion 31B formed on the outer circumferential surface of each of the bristles 31.

For the wound fiber 31B, a known material such as a PET resin (polyethylene terephthalate) is used, and the diameter thereof can appropriately be selected so as to make the helical protrusion 31B (protrusion amount) formed on the outer circumferential surface of each of the bristles 31 preferable from the viewpoint of enhancing a trapping performance and a trapping retaining performance (a catching performance) of the bristles 31 with respect to the eyelashes as well as from the viewpoint of forming a multiplicity of fine retaining spaces between the adjacent bristles 31.

A helical pitch P of the wound fiber 31B is preferably set from the viewpoint of combing, guiding, etc. of the eyelashes. As a result, the combing and guiding functions for the eyelashes are exerted not only by the bristles 31 but also by the helical wound fiber (helical protrusion) 31B (the helical pitch of the wound fiber 31B) of each of the bristles 31, so that the combing and guiding functions can be improved.

Furthermore, in this embodiment, as shown in FIG. 5, the wound fiber 31B and each of the constituent fibers 31Aa are arranged to intersect with each other based on the helical direction of the wound fiber 31B and the twist direction of the constituent fibers 31Aa, and the wound fiber 31B and each of the constituent fibers 31Aa are extended away from each other in the axial direction of the basic fiber 31A as these fibers 31B, 31Aa go further in the circumferential direction of the basic fiber 31A from each of the intersections therebetween (intersecting in a cross shape or a substantially X-shape). As a result, the wound fiber 31 tightens the plurality of the constituent fibers 31Aa so as to effectively suppress the twisting thereof, so that the whole of the plurality of the constituent fibers 31Aa constituting the basic fiber 31A is firmly bundled. Therefore, a greater frictional force etc. are generated between the constituent fibers 31Aa, which makes the rigidity and strength of each of the bristles 31 remarkably high.

When the mascara brush 20 as described above is used, the bristle group (brush part) 30 of the mascara brush 20 is immersed in the mascara liquid 12 to cause the bristle group 30 to retain the mascara liquid, and the side of the bristle group 30 is then placed under the eyelashes to perform an operation of rotating and moving the brush shaft part 22 upward. As a result, the mascara liquid 12 can be applied to the eyelashes.

In this case, since the specific surface area of each of the bristles 31 is drastically increased by the plurality of the fine groove-like recesses 33 helically extending on the outer circumferential surface of the basic fiber 31A (the plurality of the constituent fibers 31Aa) and the wound fiber 31B on the outer circumferential surface of the basic fiber 31 A, the adhesion area of each of the bristles can be increased with respect to the mascara liquid 12. Additionally, the helical protrusion 31B is formed on each of the bristles 31 by the wound fiber 31B on the outer circumferential surface of the basic fiber 31A so that a multiplicity of fine retention spaces can be formed between the adjacent bristles 31. Therefore, the bristle group 30 can be increased in the ability to retain the mascara liquid 12 more than ever so that the need to frequently immerse the bristle group 30 into the mascara liquid 12 can be eliminated to enhance the operability, and a large amount of the mascara liquid 12 can be applied to the eyelashes to easily increase the volume of the eyelashes.

Additionally, under the bristle group 30 radially attached to the core wire part 32 around the axis of the core wire part 32 continuously in a helical state in the axial direction of the core wire part 32, each of the bristles 31 has the helical protrusion 31B formed by the wound fiber 31B on the outer circumferential surface of the basic fiber 31A and, therefore, the helical state of the bristle group 30 and the helical state of the protrusion (wound fiber) 31B on each of the bristles 31 are effectively used, and the protrusion 31B on each of the bristles 31 protrudes in various directions, so that the trapping performance and the trapping retaining performance (the catching performance) of the bristles 31 can be enhanced with respect to the eyelashes. Thus, by using the mascara brush 20, a contact time (an involvement time) of the bristles 31 can be increased with respect to the eyelashes by preventing the eyelashes from easily separating from the bristles 31, so as to increase a treatment time by the bristles 31 as well as an application time and an application amount of the liquid cosmetic material to the eyelashes. As a result, fine adjustments such as curling of the eyelashes and increasing the volume of the eyelashes can more easily be performed.

Furthermore, since each of the bristles 31 has the basic fiber 31A made up of the plurality of the twisted constituent fibers 31Aa and the wound fiber 31B is helically wound around the outer circumferential surface of the plurality of the constituent fibers 31Aa (the basic fiber 31A), the plurality of constituent fibers 31Aa are welded and integrated in a tightly bundled state (a state in which a large frictional force is generated between the constituent fibers 31Aa) so that the strength and rigidity of the bristles 31 are increased. Therefore, the high strength and rigidity corresponding to the ability to retain the mascara liquid 12 can be ensured in each of the bristles 31 and the function of the bristles 31 as comb teeth can be improved.

In this case, the wound fiber 31B tightens the plurality of the constituent fibers 31Aa to effectively suppress the twist thereof so that a greater frictional force etc. are generated between the constituent fibers 31Aa, which makes the rigidity and strength of each of the bristles 31 remarkably high. Therefore, even though the ability to retain the mascara liquid 12 is improved, the cosmetic brush preferably corresponding to the improvement can accordingly be provided in terms of strength etc.

Moreover, if the mascara liquid 12 used contains fibers, the fibers contained in the mascara liquid 12 are easily entangled with the helical protrusion (wound fiber) on each of the bristles 31 when the bristle group 30 of the mascara brush 20 is immersed in the mascara liquid 12. Therefore, by using the mascara brush 2, the mascara liquid 12 containing fibers can adequately be retained in the bristle group 30 and can be applied to the eyelashes etc.

Although the embodiment has been described above, the present invention includes the following forms:

(1) using as a cosmetic brush for liquid cosmetic materials other than a mascara liquid; and (2) forming the mascara brush (cosmetic brush) 20A made up of the core wire part 32 and the bristle group 30 without the brush shaft part 22.

EXPLANATIONS OF LETTERS OR NUMERALS

20 mascara brush (cosmetic brush)
30 bristle group
31 bristle
31A basic fiber
31B wound fiber
31Aa constituent fiber
32 core wire part
33 fine groove-like recess (groove-like recess)

The invention claimed is:

1. A cosmetic brush comprising:

a core wire part; and a bristle group radially attached to the core wire part around an axis of the core wire part continuously in a helical state in an axial direction of the core wire part, the bristle group having a plurality of bristles, each bristle being made up of a basic fiber and a wound fiber helically wound around an outer circumferential surface of the basic fiber in an integrated state, and having a proximal end adjacent the core wire part and an opposing distal end, wherein the basic fiber is constituted by bundling a plurality of constituent fibers; wherein recessed grooves are formed between the constituent fibers adjacent to each other, wherein the wound fiber is helically wound around the plurality of bundled constituent fibers and extends radially farther away from a central axis of the bristle than the constituent fibers, and wherein the basic fiber and the wound fiber are welded and integrated in a tightly bundled state to form a monolithic structure along an entire length of each of the bristles from the proximal end to the distal end.

2. The cosmetic brush according to claim 1, wherein the plurality of constituent fibers serving as the basic fiber are twisted around an axis of the basic fiber.

3. The cosmetic brush according to claim 2, wherein the wound fiber is twisted around the axis of the basic fiber such that the wound fiber overlies and intersects with the constituent fibers on the exterior of the basic fiber such that the constituent fibers of the basic fiber is rigidified.

4. The cosmetic brush according to claim 1, wherein the wound fiber is helically wound around the outer circumferential surface of the basic fiber to form a helical protrusion.

5. The cosmetic brush according to claim 1 wherein the bundled plurality of constituent fibers are clamped by the wound fiber.

6. The cosmetic brush according to claim 2, wherein the winding pitch of the wound fiber and the winding pitch of the basic fiber are different.

7. The cosmetic brush according to claim 2, wherein the winding pitch of the wound fibers is half or less of the winding pitch of the basic fibers.

8. The cosmetic brush according to claim 1, wherein the wound fiber is provided as separate fiber from the basic fiber.

9. The cosmetic brush according to claim 1, wherein the cosmetic brush is a mascara brush that is an eyelash applicator, or is an eyebrow brush.

10. The cosmetic brush according to claim 2, wherein the wound fiber is wound on the basic fiber in a direction opposite to the twisting direction of the basic fiber.

* * * * *